US010288340B2

(12) United States Patent
Besore et al.

(10) Patent No.: US 10,288,340 B2
(45) Date of Patent: May 14, 2019

(54) REFRIGERATOR APPLIANCE WITH DUAL FREEZER COMPARTMENTS

(71) Applicant: Haier US Appliance Solutions, Inc., Wilmington, DE (US)

(72) Inventors: John Keith Besore, Prospect, KY (US); Brian Michael Schork, Louisville, KY (US); Christopher Edward O'Malley, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 96 days.

(21) Appl. No.: 15/428,222

(22) Filed: Feb. 9, 2017

(65) Prior Publication Data

US 2018/0224186 A1 Aug. 9, 2018

(51) Int. Cl.

| | |
|---|---|
| ***F25D 17/06*** | (2006.01) |
| ***F25D 23/06*** | (2006.01) |
| ***F25D 17/04*** | (2006.01) |

(52) U.S. Cl.

CPC ..... *F25D 17/065* (2013.01); *F25D 17/045* (2013.01); *F25D 23/066* (2013.01); *F25D 23/069* (2013.01); *F25D 2317/0682* (2013.01); *F25D 2400/06* (2013.01); *F25D 2400/16* (2013.01)

(58) Field of Classification Search

CPC ..... F25D 11/02; F25D 23/069; F25D 17/045; F25D 23/087; F25D 17/065; F25D 2400/06

USPC ..... 62/408

See application file for complete search history.

(56) References Cited

U.S. PATENT DOCUMENTS

| | | | | |
|---|---|---|---|---|
| 5,758,512 | A | 6/1998 | Peterson et al. | |
| 6,094,934 | A * | 8/2000 | Rand | A47F 3/0408 312/116 |
| 7,032,407 | B2 | 4/2006 | Chastine | |
| 8,074,469 | B2 | 12/2011 | Hamel et al. | |
| 8,141,375 | B2 | 3/2012 | Malpetti | |
| 8,191,382 | B2 | 6/2012 | Lim et al. | |
| 8,794,019 | B2 | 8/2014 | Kuehl et al. | |
| 9,217,601 | B2 | 12/2015 | Koo et al. | |
| 9,335,086 | B2 | 5/2016 | Koo et al. | |
| 2005/0236947 | A1 * | 10/2005 | LeClear | A47B 71/00 312/404 |
| 2006/0130513 | A1 | 6/2006 | Chang et al. | |
| 2008/0271475 | A1 | 11/2008 | Wuesthoff et al. | |
| 2009/0113923 | A1 | 5/2009 | Young | |

(Continued)

FOREIGN PATENT DOCUMENTS

| | | | |
|---|---|---|---|
| EP | 2339275 | A2 | 6/2011 |
| JP | 2001174125 | A | 6/2001 |
| JP | 2006275297 | A | 10/2006 |

*Primary Examiner* — Frantz F Jules
*Assistant Examiner* — Steve S Tanenbaum
(74) *Attorney, Agent, or Firm* — Dority & Manning, P.A.

(57) ABSTRACT

A refrigerator appliance is provided including a freezer chamber divided into a first compartment and a second compartment by a removable mullion. A first evaporator cover is positioned within the first compartment to define a first evaporator chamber and a second evaporator cover is positioned within the second compartment to define a second evaporator chamber. A crossover duct is defined in the mullion for providing fluid communication between the first evaporator chamber and the second evaporator chamber.

20 Claims, 15 Drawing Sheets

(56) References Cited

U.S. PATENT DOCUMENTS

2013/0098077 A1* 4/2013 Bonet ..... F25B 5/02
62/82
2015/0330695 A1* 11/2015 Miller ..... F25C 5/182
62/66

* cited by examiner

REFRIGERATOR APPLIANCE WITH DUAL FREEZER COMPARTMENTS

FIELD OF THE INVENTION

The present subject matter relates generally to refrigerator appliances, and more particularly, to refrigerator appliances having dual freezer compartments.

BACKGROUND OF THE INVENTION

Certain refrigerator appliances utilize sealed systems for cooling chilled chambers of the refrigerator appliances. A typical sealed system includes an evaporator and a fan, the fan generating a flow of air across the evaporator and cooling the flow of air. The cooled air is then provided through an opening into the chilled chamber to maintain the chilled chamber at a desired temperature. Air from the chilled chamber is circulated back through a return duct to be re-cooled by the sealed system during operation of the refrigerator appliance, maintaining the chilled chamber at the desired temperature.

Certain refrigerators appliances also include multiple fresh food and/or freezer compartments configured for maintaining different temperatures for storing different types of food and drink. For example, a conventional quad door bottom mount refrigerator has a fresh food chamber positioned above a freezer chamber. The freezer chamber may include two or more separate freezer sub-compartments that are maintained at different temperatures. More specifically, a first freezer compartment may be maintained at a conventional freezer temperature (e.g., around 0° F.), while a second "convertible" freezer compartment may be adjusted between a conventional freezer temperature and a fresh food compartment temperature (e.g., between 0° F. and 37° F.).

However, achieving different temperatures in each of the compartments of such refrigerator appliances typically requires a separate evaporator for each compartment. In this regard, a single compressor may drive refrigerant through a switching mechanism to an evaporator configured for cooling a single compartment at a time. However, additional evaporators result in added costs, more complicated assembly, and a more complex refrigerant plumbing configuration. In addition, complicated switching mechanisms may be required or operational limitations may arise, e.g., only a single compartment may be cooled at a single time due to the shared compressor.

Accordingly, a refrigerator appliance including two freezer compartments cooled by an improved refrigeration system would be useful. More particularly, a quad door refrigerator with a simple, low cost, and versatile refrigeration system would be especially beneficial.

BRIEF DESCRIPTION OF THE INVENTION

The present subject matter provides a refrigerator appliance including a freezer chamber divided into a first compartment and a second compartment by a removable mullion. A first evaporator cover is positioned within the first compartment to define a first evaporator chamber and a second evaporator cover is positioned within the second compartment to define a second evaporator chamber. A crossover duct is defined in the mullion for providing fluid communication between the first evaporator chamber and the second evaporator chamber. Additional aspects and advantages of the invention will be set forth in part in the following description, or may be apparent from the description, or may be learned through practice of the invention.

In a first exemplary embodiment a refrigerator appliance is provided. The refrigerator appliance defines a vertical direction, a lateral direction, and a transverse direction, the vertical, lateral, and transverse directions being mutually perpendicular. The refrigerator appliance includes a cabinet comprising an inner liner defining a freezer chamber and a mullion positioned within the freezer chamber and extending substantially along the transverse direction to divide the freezer chamber into a first freezer compartment and a second freezer compartment. A first evaporator cover is positioned within the first freezer compartment to define a first evaporator chamber, the first evaporator cover defining a first return duct providing fluid communication between the first freezer compartment and the first evaporator chamber. A second evaporator cover is positioned within the second freezer compartment to define a second evaporator chamber, the second evaporator cover defining a second return duct providing fluid communication between the second freezer compartment and the second evaporator chamber. An evaporator coil is positioned in both the first evaporator chamber and the second evaporator chamber, the evaporator coil passing from the first evaporator chamber to the second evaporator chamber through an evaporator recess defined by the mullion. A crossover duct is defined in the mullion for providing fluid communication between the first evaporator chamber and the second evaporator chamber.

According to another exemplary embodiment, a refrigerator appliance is provided. The refrigerator appliance includes a cabinet including an inner liner defining a freezer chamber, an evaporator coil positioned along a back wall within the freezer chamber, and a mullion positioned within the freezer chamber and extending substantially along the transverse direction to divide the freezer chamber into a first freezer compartment and a second freezer compartment, the mullion defining an evaporator recess for receiving the evaporator coil. A first evaporator cover is positioned within the first freezer compartment, the first evaporator cover, the mullion, and the inner liner defining a first evaporator chamber. A second evaporator cover is positioned within the second freezer compartment, the second evaporator cover, the mullion, and the inner liner defining a second evaporator chamber. A crossover duct provides fluid communication between the first evaporator chamber and the second evaporator chamber.

According to still another exemplary embodiment, a refrigerator appliance is provided. The refrigerator appliance defines a vertical direction, a lateral direction, and a transverse direction, the vertical, lateral, and transverse directions being mutually perpendicular. The refrigerator appliance includes a cabinet including an inner liner defining a freezer chamber, a mullion positioned within the freezer chamber and extending substantially along the transverse direction to divide the freezer chamber into a first freezer compartment and a second freezer compartment, and an evaporator cover positioned within the freezer chamber to define an evaporator chamber, the evaporator chamber having a first region proximate the first freezer compartment and a second region proximate the second freezer compartment. The evaporator cover defines a first return duct providing fluid communication between the first freezer compartment and the first region of the evaporator chamber and a second return duct providing fluid communication between the second freezer compartment and the second region of the evaporator chamber. An evaporator coil is positioned within the evaporator chamber, the evaporator coil configured for cooling air in the evaporator chamber. A crossover duct is positioned within the evaporator chamber and providing fluid communication between the first region of the evaporator chamber and the second region of the evaporator chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
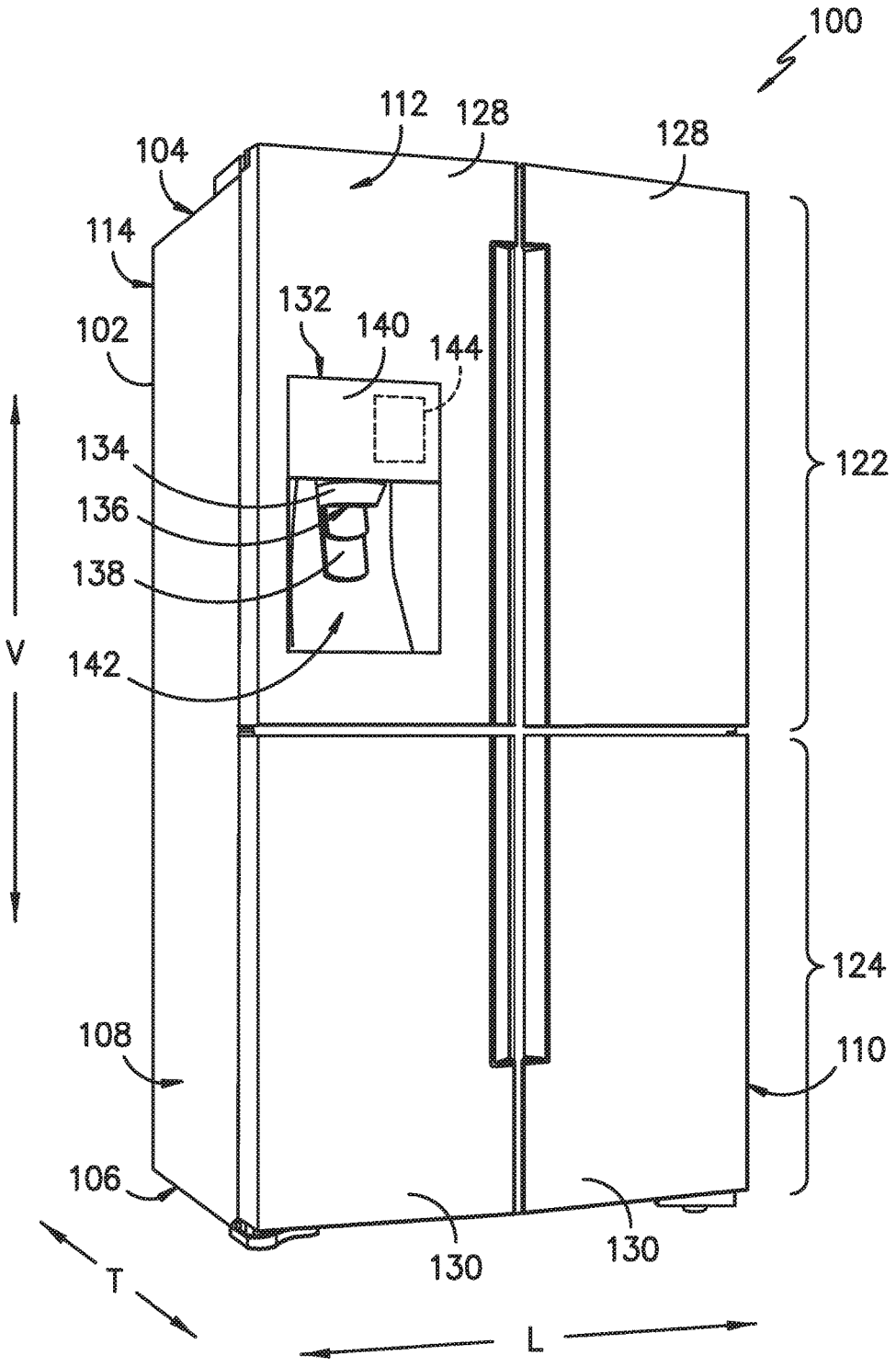
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. Similarly, freezer doors 130 are rotatably hinged to an edge of housing 102 for selectively accessing freezer chamber 124. To prevent leakage of cool air, refrigerator doors 128, freezer doors 130, and/or housing 102 may define one or more sealing mechanisms (e.g., rubber gaskets, not shown) at the interface where the doors 128, 130 meet housing 102. Refrigerator doors 128 and freezer doors 130 are shown in the closed configuration in FIG. 1 and in the open configuration in FIG. 2. It should be appreciated that doors having a different style, position, or configuration are possible and within the scope of the present subject matter.

Refrigerator appliance 100 also includes a dispensing assembly 132 for dispensing liquid water and/or ice. Dispensing assembly 132 includes a dispenser 134 positioned on or mounted to an exterior portion of refrigerator appliance 100, e.g., on one of refrigerator doors 128. Dispenser 134 includes a discharging outlet 136 for accessing ice and liquid water. An actuating mechanism 138, shown as a paddle, is mounted below discharging outlet 136 for operating dispenser 134. In alternative exemplary embodiments, any suitable actuating mechanism may be used to operate dispenser 134. For example, dispenser 134 can include a sensor (such as an ultrasonic sensor) or a button rather than the paddle. A control panel 140 is provided for controlling the mode of operation. For example, control panel 140 includes a plurality of user inputs (not labeled), such as a water dispensing button and an ice-dispensing button, for selecting a desired mode of operation such as crushed or non-crushed ice.

Discharging outlet 136 and actuating mechanism 138 are an external part of dispenser 134 and are mounted in a dispenser recess 142. Dispenser recess 142 is positioned at a predetermined elevation convenient for a user to access ice or water and enabling the user to access ice without the need to bend-over and without the need to open refrigerator doors 128. In the exemplary embodiment, dispenser recess 142 is positioned at a level that approximates the chest level of a user. According to an exemplary embodiment, the dispensing assembly 132 may receive ice from an icemaker disposed in a sub-compartment of the fresh food chamber 122.

Refrigerator appliance 100 further includes a controller 144. Operation of the refrigerator appliance 100 is regulated by controller 144 that is operatively coupled to control panel 140. In one exemplary embodiment, control panel 140 may represent a general purpose I/O ("GPIO") device or functional block. In another exemplary embodiment, control panel 140 may include input components, such as one or more of a variety of electrical, mechanical or electromechanical input devices including rotary dials, push buttons, touch pads, and touch screens. Control panel 140 may be in communication with controller 144 via one or more signal lines or shared communication busses. Control panel 140 provides selections for user manipulation of the operation of refrigerator appliance 100. In response to user manipulation of the control panel 140, controller 144 operates various components of refrigerator appliance 100. For example, controller 144 is operatively coupled or in communication with various components of a sealed system, as discussed below. Controller 144 may also be in communication with a variety of sensors, such as, for example, chamber temperature sensors or ambient temperature sensors. Controller 144 may receive signals from these temperature sensors that correspond to the temperature of an atmosphere or air within their respective locations.

Controller 144 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 144 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
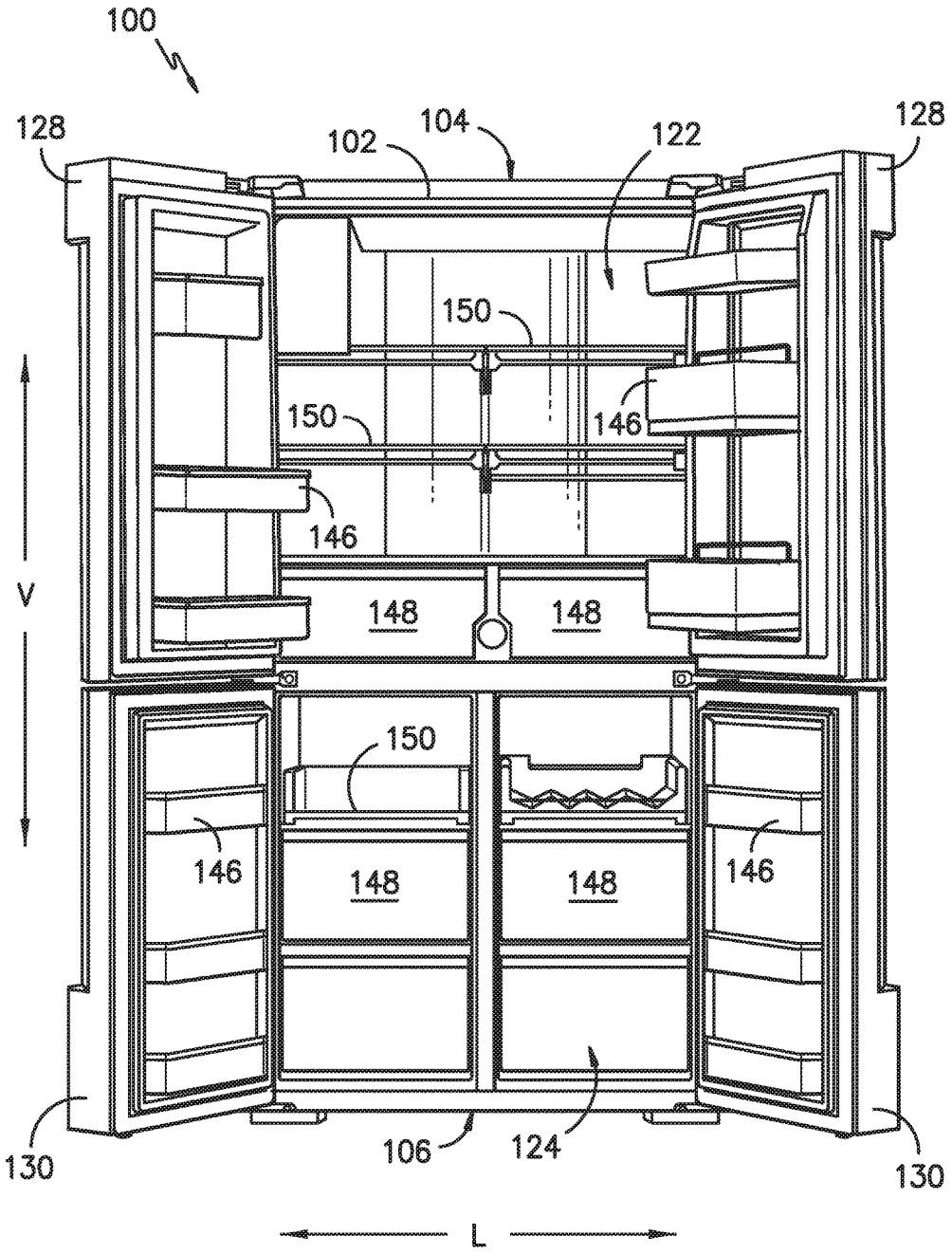
FIG. 2 provides a front view of the exemplary refrigerator appliance of FIG. 1 with the refrigerator and freezer doors shown in an open position.

FIG. 2 provides a front view of refrigerator appliance 100 with refrigerator doors 128 and freezer doors 130 shown in an open position. According to the illustrated embodiment, various storage components are mounted within fresh food chamber 122 and freezer chamber 124 to facilitate storage of food items therein as will be understood by those skilled in the art. In particular, the storage components include bins 146, drawers 148, and shelves 150 that are mounted within fresh food chamber 122 or freezer chamber 124. Bins 146, drawers 148, and shelves 150 are configured for receipt of food items (e.g., beverages and/or solid food items) and may assist with organizing such food items. As an example, drawers 148 can receive fresh food items (e.g., vegetables, fruits, and/or cheeses) and increase the useful life of such fresh food items.

Figure 3:
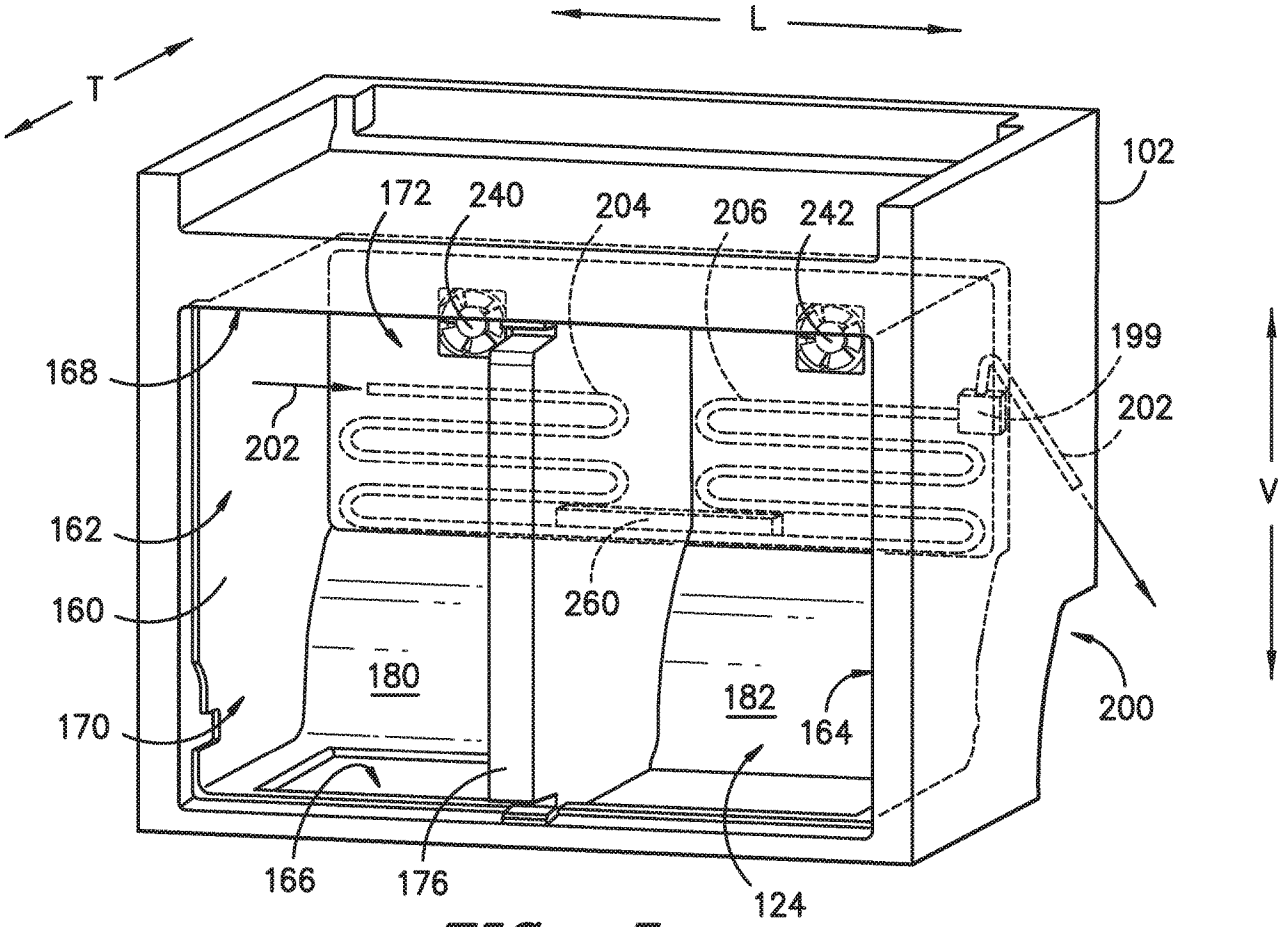
FIG. 3 provides a perspective view of a freezer chamber of the exemplary refrigerator appliance of FIG. 1 with the freezer doors and storage bins removed for clarity according to an exemplary embodiment of the present subject matter.
Figure 4:
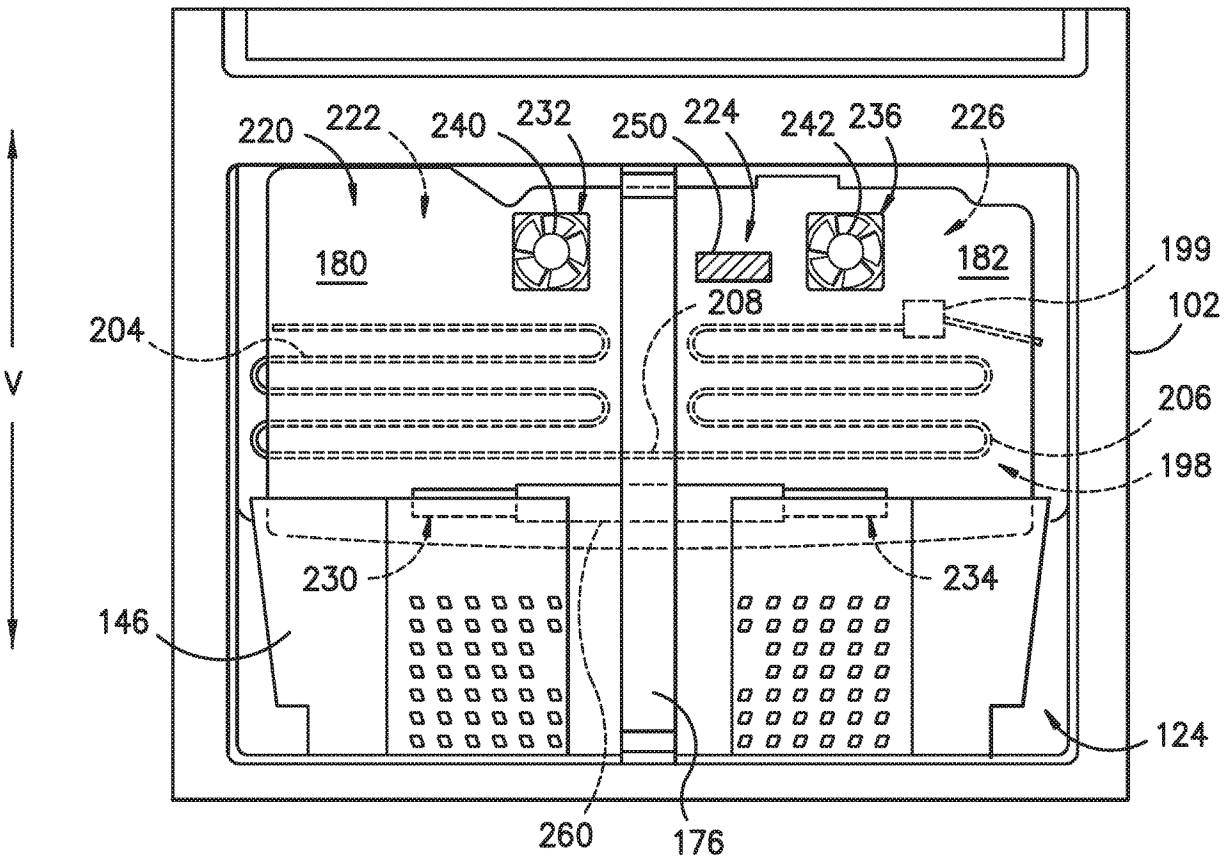
FIG. 4 provides a front view of the exemplary freezer chamber of FIG. 3.

Referring now to FIGS. 3 and 4, freezer chamber 124 will be described according to exemplary an exemplary embodiment of the present subject matter. As illustrated, cabinet or housing 102 includes an inner liner 160 which defines freezer chamber 124. For example, inner liner 160 may be an injection-molded door liner attached to an inside of housing 102. Insulation (not shown), such as expandable foam can be present between housing 102 and inner liner 160 in order to assist with insulating freezer chamber 124. For example, sprayed polyurethane foam may be injected into a cavity defined between housing 102 and inner liner 160 after they are assembled. Freezer doors 130 may be constructed in a similar manner to assist in insulating freezer chamber 124.

Freezer chamber 124 generally extends between a left wall 162 and a right wall 164 along the lateral direction L, between a bottom wall 166 and a top wall 168 along the vertical direction V, and between a chamber opening 170 and a back wall 172 along the transverse direction T. Refrigerator appliance 100 further includes a mullion 176 positioned within freezer chamber 124 to divided freezer chamber 124 into a first freezer compartment 180 and a second freezer compartment 182. According to the illustrated embodiment, mullion 176 generally extends between chamber opening 170 and back wall 172 along the transverse direction T and between bottom wall 166 and top wall 168 along the vertical direction V. In this manner, mullion 176 is generally vertically-oriented and splits freezer chamber 124 into two equally-sized compartments 180, 182.

To limit heat transfer between first freezer compartment 180 and second freezer compartment 182, mullion 176 may generally be formed from an insulating material such as foam. In addition, to provide structural support, a rigid injection molded liner or a metal frame may surround the insulating foam. According to another exemplary embodiment, mullion 176 may be a vacuum insulated panel or may contain a vacuum insulated panel to minimize heat transfer between first freezer compartment 180 and second freezer compartment 182. According to an exemplary embodiment, inner liner 160 and/or mullion 176 may include features such as guides or slides, e.g., to ensure proper positioning, installation, and sealing of mullion 176 within inner liner 160.

A seal, such as a rubber or foam gasket (not shown), may be positioned around a perimeter of mullion 176 where it contacts inner liner 160 and/or freezer doors 130. In addition, mullion 176 can be formed to have the same shape as inner liner 160 such that a tight seal is formed when mullion 176 is installed. However, as further described below, mullion 176 may further include recesses, apertures, or passageways where needed to allow refrigeration system components to pass through mullion 176.

According to the exemplary embodiment, mullion 176 is removable such that inner liner 160 may be formed in the same shape as conventional single compartment freezer chambers. In this manner, the same tooling may be used to form both refrigerator appliances, thereby reducing costs. Although mullion 176 is illustrated as extending vertically through a middle of freezer chamber 124, it should be appreciated that mullion 176 may be sized, positioned, and configured in any suitable manner to form separate freezer sub-compartments within freezer chamber 124.

Figure 5:
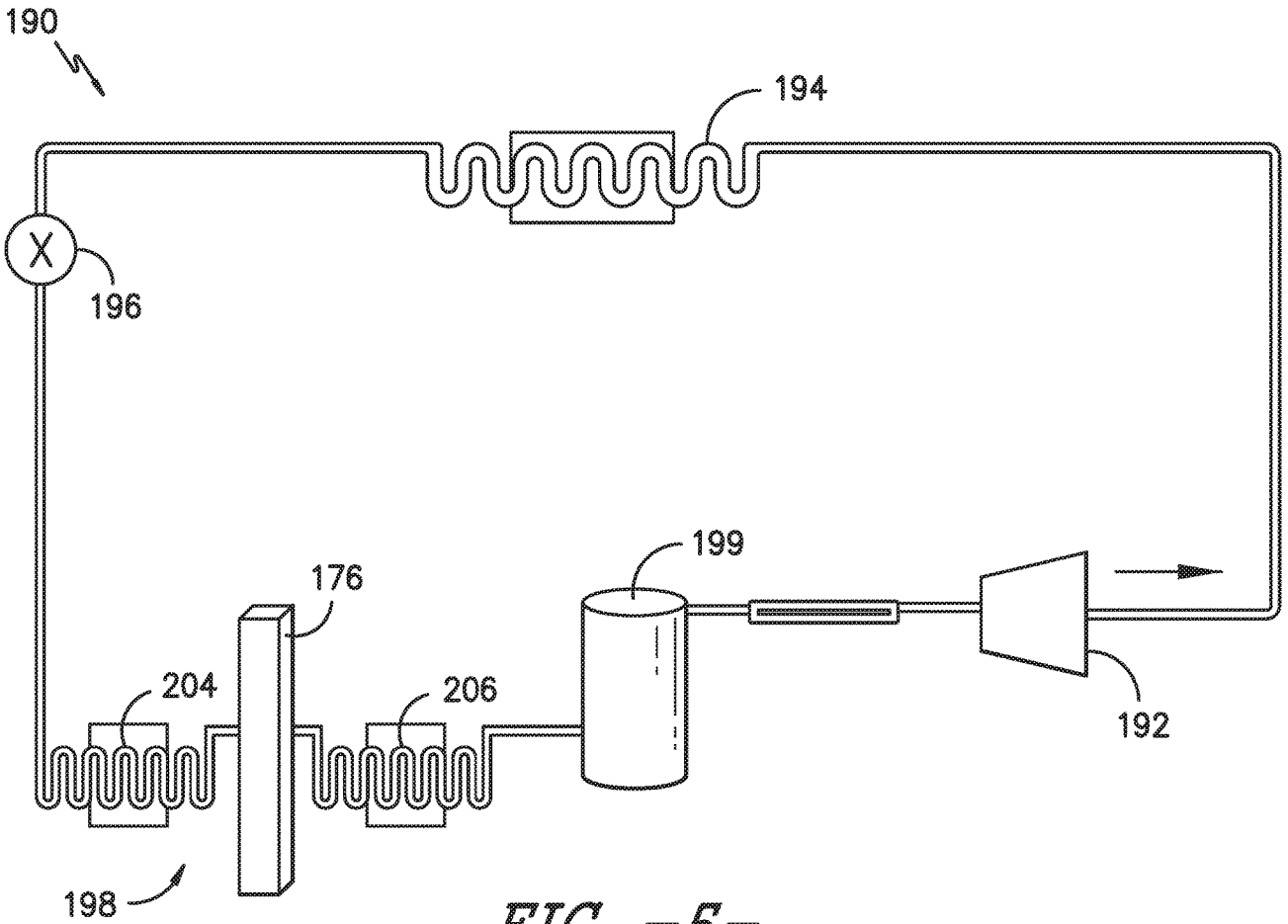
FIG. 5 provides a schematic view of a sealed cooling system configured for cooling the exemplary freezer chamber of FIG. 3 according to an exemplary embodiment of the present subject matter.

Referring now to FIG. 5, a schematic view of an exemplary sealed system 190 which may be used to cool freezer chamber 124 will be described. Sealed system 190 is generally configured for executing a vapor compression cycle for cooling air within refrigerator appliance 100, e.g., within fresh food chamber 122 and freezer chamber 124. Sealed cooling system 190 includes a compressor 192, a condenser 194, an expansion device 196, and an evaporator 198 connected in series and charged with a refrigerant.

During operation of sealed system 190, gaseous refrigerant flows into compressor 192, which operates to increase the pressure of the refrigerant. This compression of the refrigerant raises its temperature, which is lowered by passing the gaseous refrigerant through condenser 194. Within condenser 194, heat exchange with ambient air takes place so as to cool the refrigerant and cause the refrigerant to condense to a liquid state.

Expansion device (e.g., a valve, capillary tube, or other restriction device) 196 receives liquid refrigerant from condenser 194. From expansion device 196, the liquid refrigerant enters evaporator 198. Upon exiting expansion device 196 and entering evaporator 198, the liquid refrigerant drops in pressure and vaporizes. Due to the pressure drop and phase change of the refrigerant, evaporator 198 is cool relative to fresh food and freezer chambers 122 and 124 of refrigerator appliance 100. As such, cooled air is produced and refrigerates fresh food and freezer chambers 122 and 124 of refrigerator appliance 100. Thus, evaporator 198 is a type of heat exchanger which transfers heat from air passing over evaporator 198 to refrigerant flowing through evaporator 198.

It should be appreciated that the illustrated sealed system 190 is only one exemplary configuration of sealed system 190 which may include additional components, e.g., one or more additional evaporators, compressors, expansion devices, and/or condensers. As an example, sealed cooling system 190 may include two evaporators. As a further example, sealed system 190 may further include an accumulator 199. Accumulator 199 may be positioned downstream of evaporator 198 and may be configured to collect condensed refrigerant from the refrigerant stream prior to passing it to compressor 192.

Referring again generally to FIGS. 3 and 4, evaporator 198 is positioned adjacent back wall 172 of inner liner 160. The remaining components of sealed system 190 are typically located within a machinery compartment 200 of refrigerator appliance 100. A conduit 202 may pass refrigerant into freezer chamber 124 to evaporator 198 through a fluid tight inlet and may pass refrigerant from evaporator 198 out of freezer chamber 124 through a fluid tight outlet.

Figure 7:
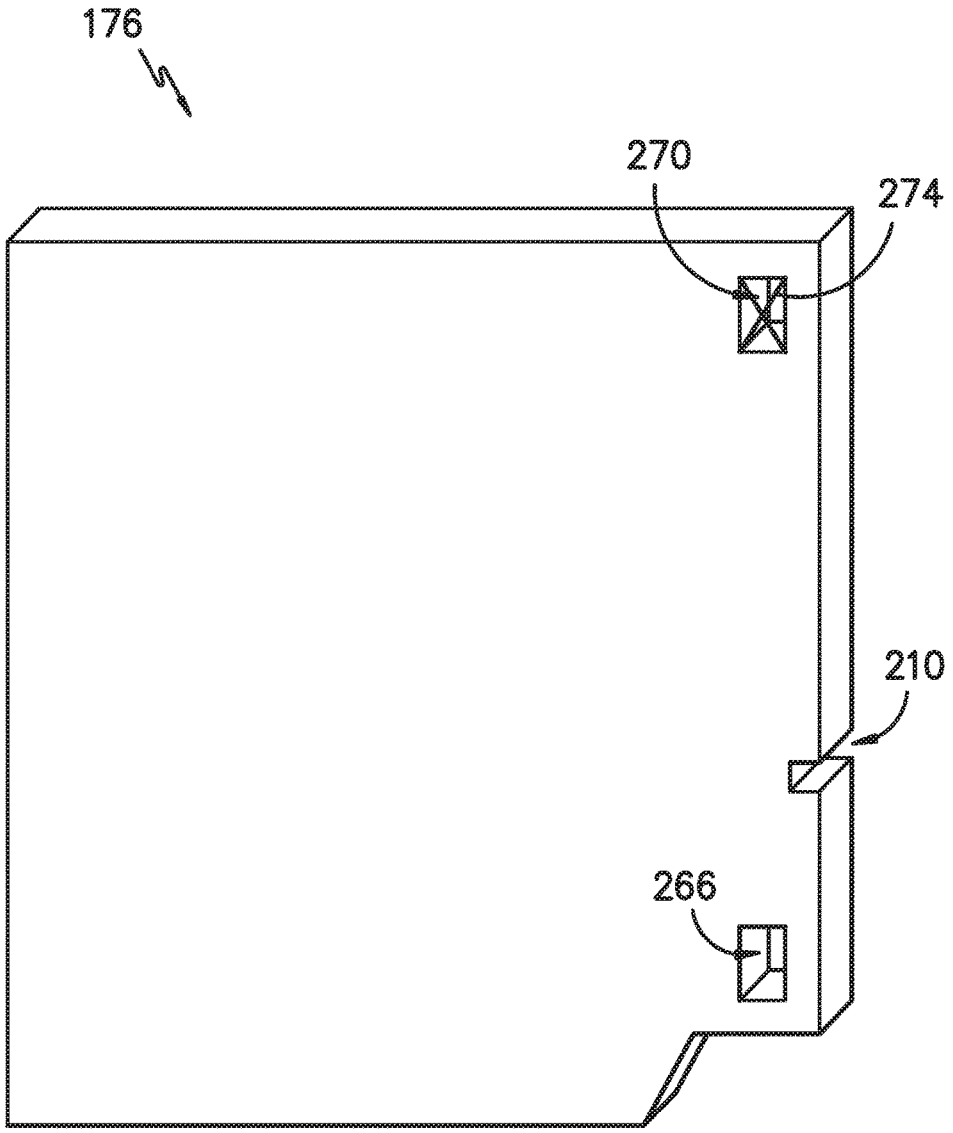
FIG. 7 provides a perspective view of a mullion used with the exemplary freezer chamber of FIG. 3 according to one exemplary embodiment of the present subject matter.

According to the illustrated embodiment, evaporator 198 includes a first evaporator section 204 and a second evaporator section 206. First evaporator section 204 and second evaporator section 206 are connected in series such that refrigerant passes first through first evaporator section 204 before second evaporator section 206. More specifically, according to the illustrated embodiment, first evaporator section 204 and second evaporator section 206 are coupled by a transition tube 208. Transition tube 208 may be a separate connecting conduit or a part of the same tube forming evaporator 198. As illustrated, first evaporator section 204 is positioned within first freezer compartment 180 and second evaporator section 206 is positioned within second freezer compartment 182. In this regard, transition tube 208 may pass through an aperture 210 in mullion 176 (FIG. 7).

An evaporator cover is typically placed over evaporator 198 to form an evaporator chamber with inner liner 160. For example, as illustrated, a first evaporator cover 220 is positioned within first freezer compartment 180 over evaporator 198, or more specifically, over first evaporator section 204. In this manner, inner liner 160, mullion 176, and first evaporator cover 220 define a first evaporator chamber 222 which houses first evaporator section 204. Similarly, a second evaporator cover 224 is positioned within second freezer compartment 182 over evaporator 198, or more specifically, over second evaporator section 206. In this manner, inner liner 160, mullion 176, and second evaporator cover 224 define a second evaporator chamber 226 which houses second evaporator section 206.

Evaporator chambers 222, 226 generally include one or more return ducts and supply ducts to allow air to circulate to and from first freezer compartment 180 and second freezer compartment 182. According to the illustrated exemplary embodiment, first evaporator cover 220 defines a first return duct 230 for allowing air to enter first evaporator chamber 222 and a first supply duct 232 for exhausting air out of first evaporator chamber 222 into first freezer compartment 180. Similarly, second evaporator cover 224 defines a second return duct 234 for allowing air to enter second evaporator chamber 226 and a second supply duct 236 for exhausting air out of second evaporator chamber 226 into second freezer compartment 182. According to the illustrated embodiment, first return duct 230 and second return duct 234 are positioned proximate a bottom of freezer chamber 224 (e.g., proximate bottom wall 166) and first supply duct 232 and second supply duct 236 are positioned proximate a top of freezer chamber 224 (e.g., proximate top wall 168). It should be appreciated, however, that according to alternative embodiments, any other suitable means for providing fluid communication between the evaporator chambers and the freezer compartments are possible and within the scope of the present subject matter.

Refrigerator appliance 100 may include one or more fans to assist in circulating air through evaporator 198 and chilling freezer compartments 180, 182. For example, according to the illustrated exemplary embodiment refrigerator appliance 100 includes a first fan 240 in fluid communication with first evaporator chamber 222 for urging air through first evaporator chamber 222. More specifically, first fan 240 may be an axial fan positioned within first supply duct 232 for urging chilled air from first evaporator chamber 222 into first freezer compartment 180 through first supply duct 232 while recirculating air through first return duct 230 back into first evaporator chamber 222 to be re-cooled. Similarly, refrigerator appliance 100 includes a second fan 242 in fluid communication with second evaporator chamber 226 for urging air through second evaporator chamber 226. More specifically, second fan 242 may be an axial fan positioned within second supply duct 236 for circulating air between second evaporator chamber 226 and second freezer compartment 182, as described above.

Even when fans 240, 242 are not actively circulating chilled air, air may enter freezer compartments 180, 182 through ducts 230, 232, 234, and/or 236. In certain situations, such as when second freezer compartment 182 is being maintained at relatively high temperatures, it may be desirable to stop this unintended flow of chilled air. Therefore, refrigerator appliance may also include one or more damper assemblies configured for selectively opening and closing the supply and return ducts. More specifically, according to the exemplary embodiment illustrated in FIGS. 6 and 12, a supply damper 244 is operably coupled to second supply duct 236 and a return damper 246 is operably coupled with second return duct 234. In this manner, supply damper 244 and return damper 246 may be selectively opened and closed to allow or block the flow of cooling air into second freezer compartment 182. Although refrigerator appliance 100 is illustrated as only having supply damper 244 and return damper 246 in second freezer compartment 182, it should be appreciated that first freezer apartment could also include dampers to selectively block the flow of cooling air. Notably, supply damper 244 and return damper 246 may either be passive (e.g., flapper-style dampers) or active (e.g., motorized). According to the illustrated embodiment, supply damper 244 is passive and may be prevent leakage into second freezer compartment 182 unless second fan 242 is running due to the negative pressure in second evaporator chamber 226, e.g., due to operation of second fan 242. By contrast, return damper 246 is motorized so that it can remain in a closed position even when a negative pressure is generated in second evaporator chamber 226.

According to an exemplary embodiment, it may be desirable to raise the temperature of second freezer compartment 182 such that it may reach and maintain temperatures close to fresh food chamber 122 (e.g., around or above 37° F.). However, heat transfer between adjacent lower temperature compartments, such as first freezer compartment 180 and second evaporator chamber 226, may result in second freezer compartment 182 dropping below the desired temperature. Therefore, second freezer compartment 182 may include features for allowing higher temperature relative to first freezer compartment 180, thus making it a true "convertible" chamber which may vary between freezer temperature and fresh food temperatures.

For example, according to an exemplary embodiment, second evaporator cover 224 can incorporate a vacuum insulated panel behind the plastic panel for enhanced insulation properties which will lessen the heat required to attain elevated temperatures in second evaporator chamber 226. In this manner, second evaporator cover 224 may help prevent undesirable heat transfer between second evaporator chamber 226 to second freezer compartment 182. In addition, refrigerator appliance 100 may further include a heater assembly 250 positioned within second freezer compartment 182. Heater assembly 250 is generally configured for raising the temperature of second freezer compartment 182. Heating assembly 250 may also assist in preventing undesired freezing or facilitate thawing of evaporator 198 by heating air prior to passing it through second return duct 234. Heating assembly 250 may include one or more heating elements, such as a strip resistance heater, heating coils, or any other suitable heating elements.

Using the features described above, refrigerator appliance 100 is able to maintain first freezer compartment 180 at a fixed, relatively low temperature (e.g., around 0° F.), while allowing second freezer compartment 182 to be selectively adjusted anywhere between the freezer temperature and the fresh food compartment temperature (e.g., between around 0° F. and 37° F.). More specifically, to maintain both first freezer compartment 180 and second freezer compartment 182 at relatively low temperatures (e.g., around 0° F.), both dampers 244, 246 may be opened and both fans 240, 242 may operate to circulate air through first evaporator chamber 222 and second evaporator chamber 226.

In addition, it may be desirable to use second freezer compartment 182 as a "convertible" cooling chamber. In this regard, for example, the temperature of second freezer compartment 182 may be maintained at a slightly higher temperature than first freezer compartment 180, e.g., around 10° F., by simply shutting off second fan 242 and/or partially closing one or more of supply damper 244 and return damper 246. To adjust the temperature of second freezer compartment 182 even higher, dampers 244, 246 may be closed entirely. In addition, to increase the temperature of second freezer compartment 182 close to or above the temperature of fresh food compartment 122 (e.g., around or above 37° F.), heating assembly 250 may be energized as needed to achieve the desired temperature.

By using second freezer compartment 182 as a "convertible" compartment, imbalances in the utilization of evaporator 198 may occur. For example, if second fan 242 is turned off and/or dampers 244, 246 are closed to raise the temperature of second freezer compartment 182, there will be less airflow through second evaporator chamber 226. This may result in the accumulation of frost on first evaporator section 204 and may cause inefficiencies of evaporator 198 and sealed system 190 operation. Accordingly, features for improving utilization of all of evaporator 198 regardless of the temperature set points of first freezer compartment 180 and second freezer compartment 182 will be described below.

For example, refrigerator appliance 100 may further include one or more crossover ducts for providing fluid communication between first evaporator chamber 222 and second evaporator chamber 226. More specifically, refrigerator appliance includes a return crossover duct 260 proximate return ducts 230, 234. As illustrated, return crossover duct 260 is an insulated duct that extends from a crossover inlet 262 proximate first return duct 230 in first evaporator chamber 222 to a crossover outlet 264 proximate second return duct 234 in second evaporator chamber 226. In this regard, return crossover duct 260 is a conduit or passageway that extends substantially along the lateral direction L. However, it should be appreciated that return crossover duct 260 may be any passageway that provides fluid communication between first evaporator chamber 222 and second evaporator chamber 226.

Referring briefly to FIG. 7, a perspective view of mullion 176 according to one exemplary embodiment of the present subject matter is provided. As shown, mullion 176 defines a return crossover aperture 266. Return crossover duct 260 may be a duct or conduit that extends through return crossover aperture 266. Alternatively, no dedicated conduit is required and return crossover aperture 266 may itself serve as return crossover duct 260. Similarly, still referring to FIG. 7, refrigerator appliance 100 may further include a supply crossover aperture 270. Supply crossover aperture 270 may be configured for receiving a supply crossover duct (similar or identical to return crossover duct 260) or may otherwise provide fluid communication between first evaporator chamber 222 and second evaporator chamber 226 proximate supply ducts 232, 236. Supply crossover aperture 270 may be configured in a similar manner as return crossover aperture 266 and/or crossover duct 260.

According to the exemplary illustrated embodiment, return crossover duct 260 and supply crossover aperture 270 further include dampers to selectively open or close their respective passageways. For example, a return crossover damper 272 is positioned within crossover duct 260 and is configured for selectively opening or closing crossover duct 260, e.g., when it is desirable to isolate first evaporator chamber 222 and second evaporator chamber 226. Similarly, a supply crossover damper 274 is positioned within supply crossover aperture 270 and is configured for selectively opening or closing supply crossover aperture 270, e.g., when it is desirable to isolate first evaporator chamber 222 and second evaporator chamber 226. Similar to supply damper 244 and return damper 246 discussed above, dampers 272, 274 may be passive (e.g., flapper-style dampers) or active (e.g., motorized).

Figure 6:
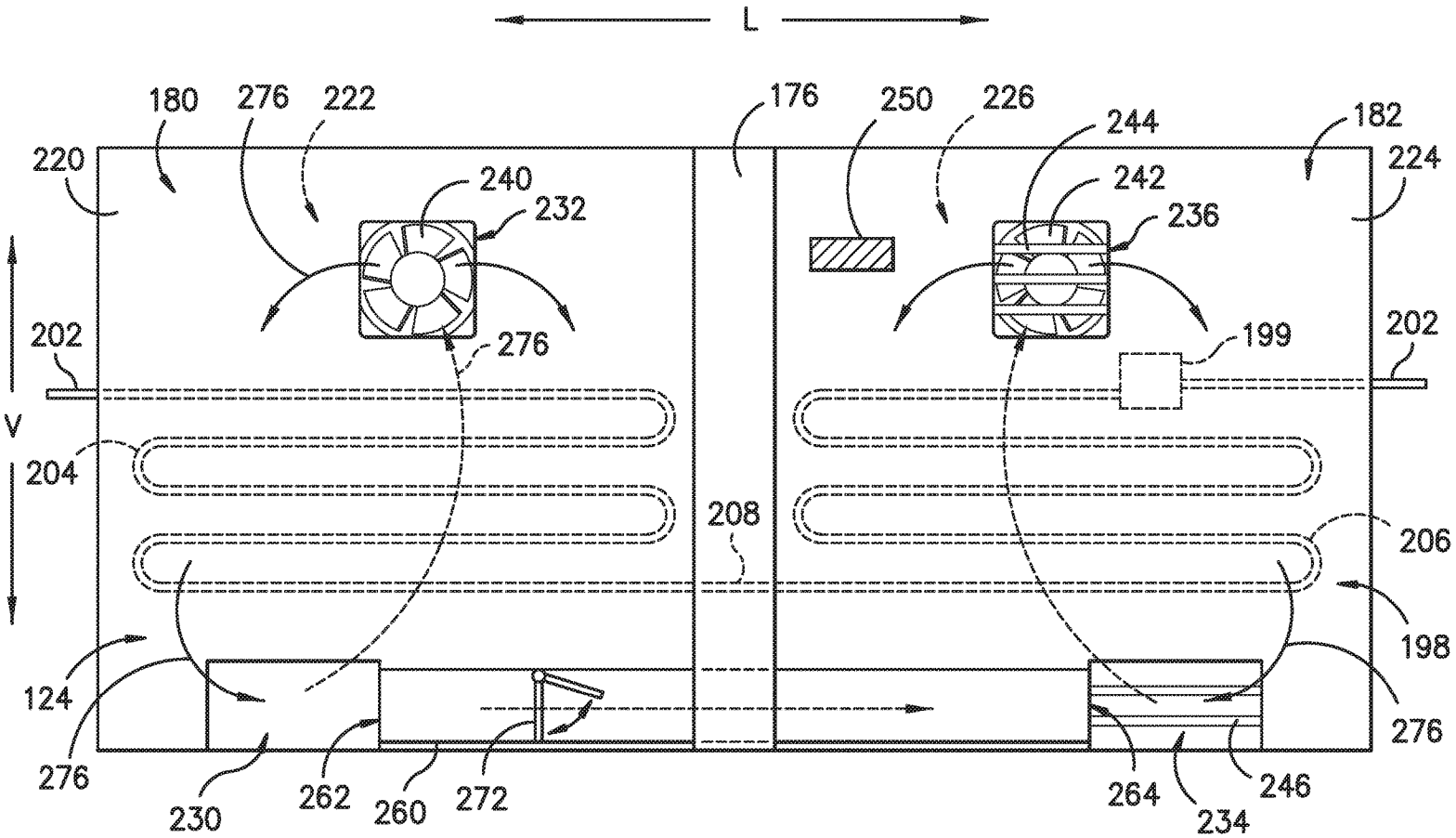
FIG. 6 provides a schematic front view of the exemplary freezer chamber of FIG. 3 to illustrate a path of cooling air flow according to an exemplary embodiment of the present subject matter.

Referring now to FIG. 6, a schematic illustration of the operation of crossover duct 260 is provided. Cooling airflow is indicated by arrows 276, with dotted lines indicating the airflow behind first evaporator cover 220 and second evaporator cover 224. As shown, first fan 240 urges chilled air from first evaporator chamber 222 into first freezer compartment 180. After cooling first freezer compartment 180, air is drawn back into first evaporator chamber 222 through first return duct 230, where it is drawn through evaporator 198, or more specifically, through first evaporator section 204 and is chilled before being recirculated. A similar process occurs in the second freezer compartment 182. Notably, however, return crossover damper 272 is open in FIG. 6, thus allowing return air from first freezer compartment 180 to travel through crossover duct 260 to second evaporator chamber 226. Particularly when less air is circulated in second freezer compartment 182, the airflow balance enabled by crossover duct 260 may improve system efficiency and reduce the likelihood of frosting on evaporator 198.

Figure 8:
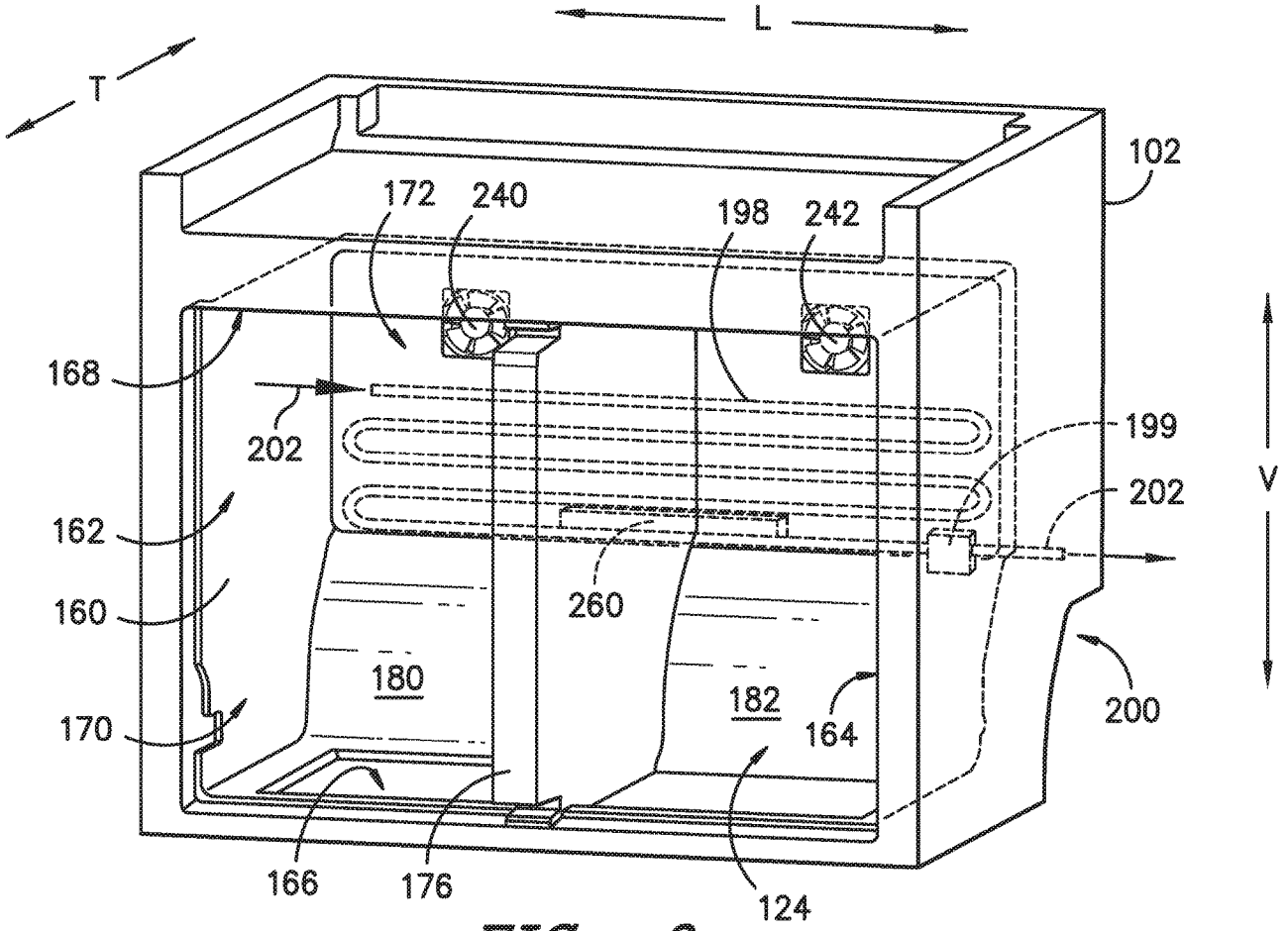
FIG. 8 provides a perspective view of a freezer chamber of the exemplary refrigerator appliance of FIG. 1 according to another exemplary embodiment of the present subject matter.
Figure 9:
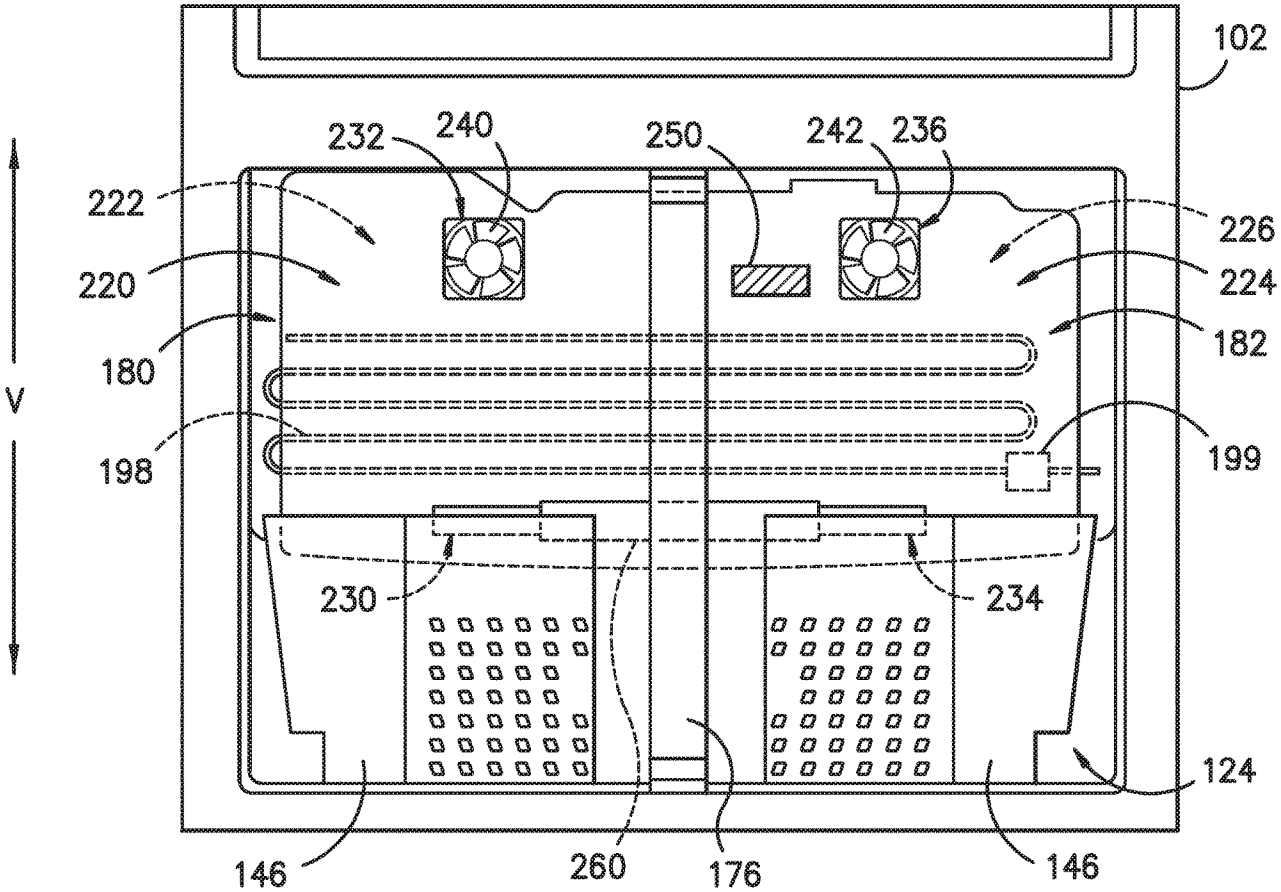
FIG. 9 provides a front view of the exemplary freezer chamber of FIG. 8.
Figure 10:
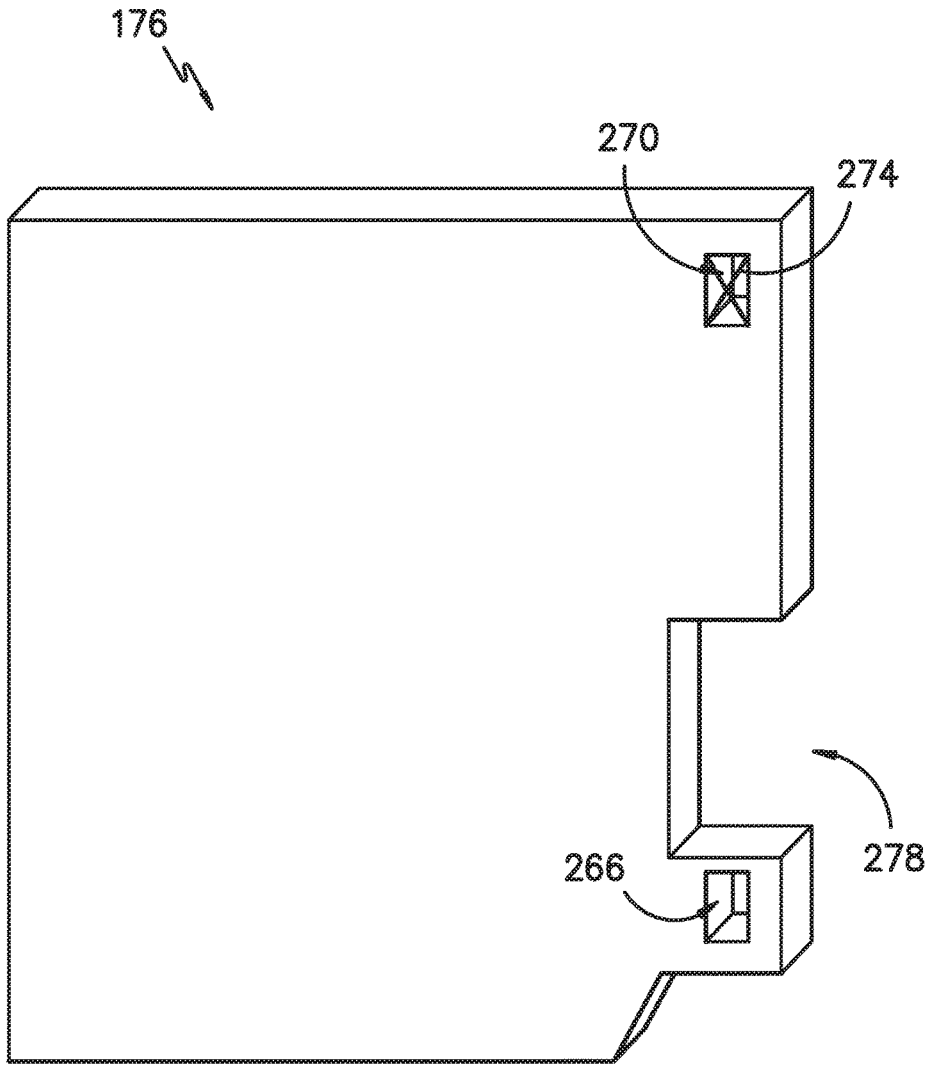
FIG. 10 provides a perspective view of a mullion used with the exemplary freezer chamber of FIG. 8 according to another exemplary embodiment of the present subject matter.

Referring now to FIGS. 8 through 10, a freezer chamber 124 and sealed system configuration will be described according to another exemplary embodiment of the present subject matter. Due to the similarity of these configurations, like reference numerals will be used to refer to the same or similar features. The primary difference in this embodiment is that evaporator 198 is not divided into two sections. Instead, evaporator 198 extends along an entire width of freezer chamber 124 similar to a more conventional single compartment evaporator configuration. To accommodate this, mullion 176 defines an evaporator aperture 278 through which evaporator 198 may pass through mullion 176.

Referring now to FIGS. 11 through 15, a diverter assembly 300 which may be used according to exemplary embodiments of the present subject matter will be described. Diverter assembly 300 will be described herein as being used with refrigerator appliance 100, or more particularly, with sealed system 190 for cooling freezer chamber 124. However, it should be appreciated that diverter assembly 300 may be used to selectively direct chilled air within any sealed system or cooling passageways. Due to the similarity between this and previous embodiments, like reference numerals will be used to refer to the same or similar features.

Figure 11:
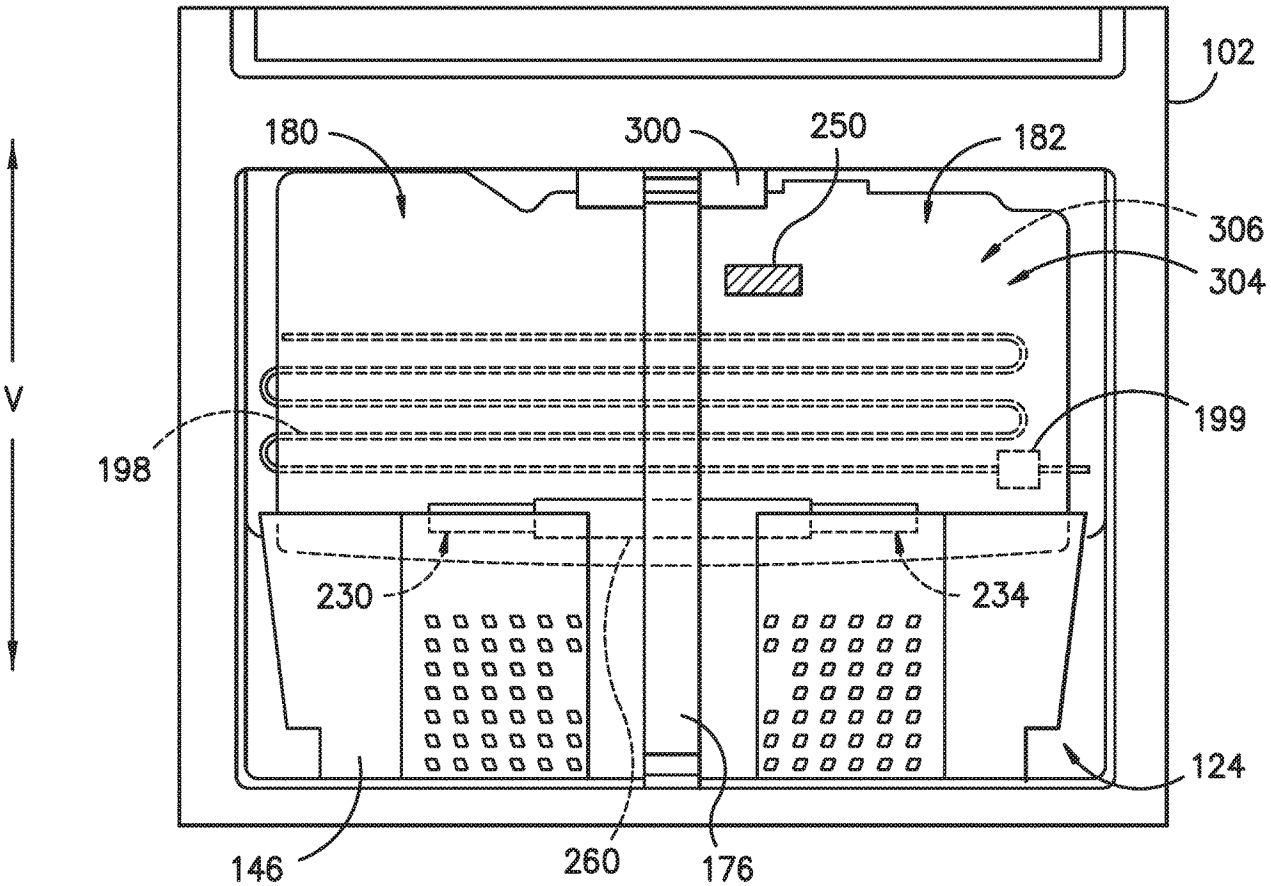
FIG. 11 provides a front view of a freezer chamber containing a diverter assembly according to still another exemplary embodiment of the present subject matter.
Figure 12:
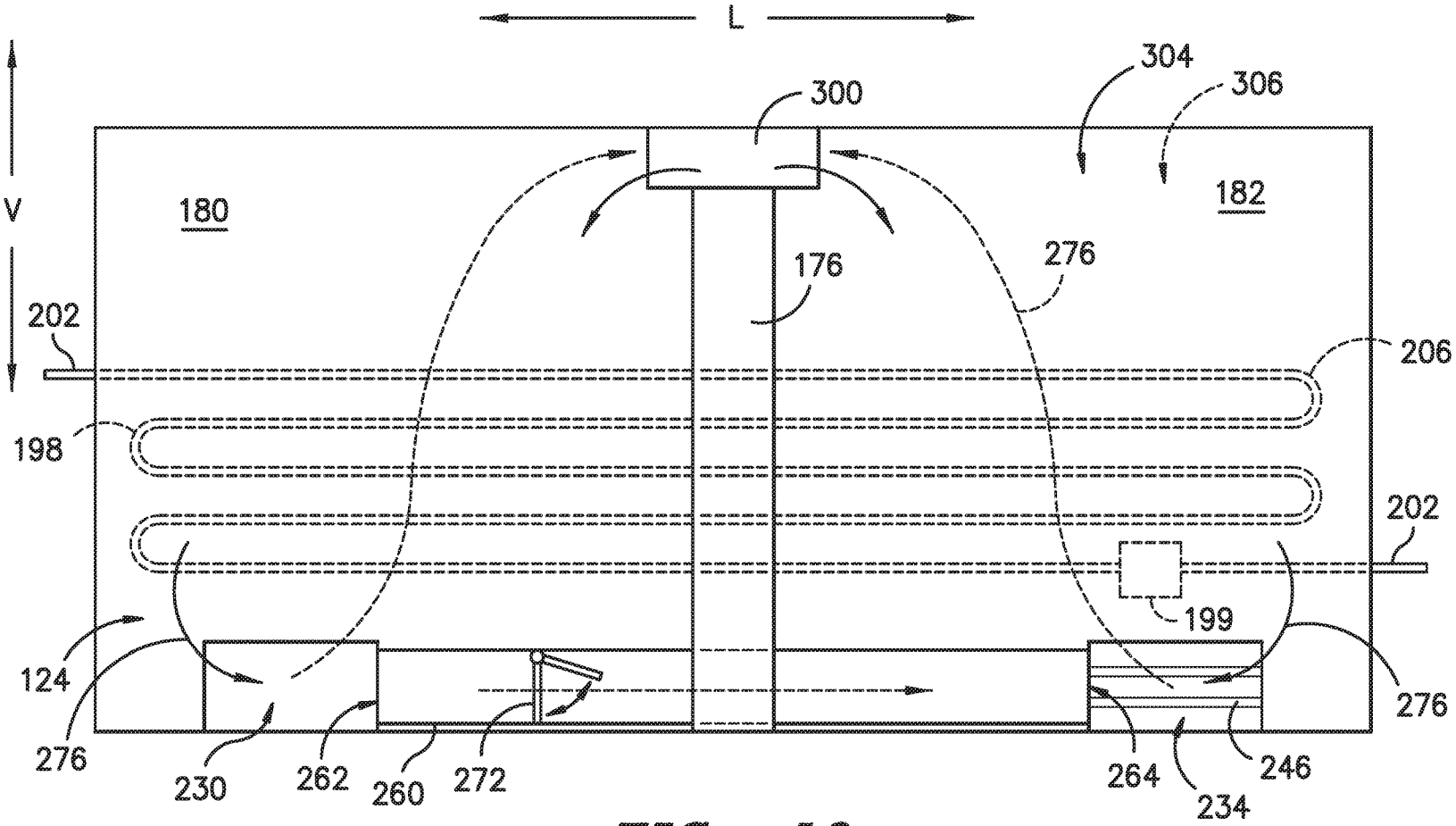
FIG. 12 provides a schematic front view of the exemplary freezer chamber of FIG. 11 to illustrate a path of cooling air flow according to an exemplary embodiment of the present subject matter.

Referring specifically to FIGS. 11 and 12, diverter assembly 300 is positioned proximate top wall 168 of inner liner 160. In this regard, mullion 176 may define a recess 302 that is configured to receive diverter assembly 300. However, it should be appreciated that according to alternative embodiments, diverter assembly 300 may be positioned in any suitable location within freezer chamber 124. For example, diverter assembly 300 could alternatively be positioned entirely within an evaporator chamber and may pass chilled air to various compartments through separate ducts or conduits.

According to the illustrated embodiment, a single evaporator cover 304 is used to define a single evaporator chamber 306. In such an embodiment, for example, mullion 176 may stop at and seal against evaporator cover 304 and diverter assembly 300 may provide fluid communication between evaporator chamber 306 and the rest of freezer chamber 124. Other configurations are possible and within the scope of the present subject matter. For example, evaporator chamber 306 may be split into two sections as illustrated in the exemplary embodiments of FIGS. 3 through 10.

As shown in FIG. 12, the cooling airflow in freezer chamber 124 when using diverter assembly 300 is substantially similar to the embodiments described above, except that all of the supply air flow is passed through diverter assembly 300. In this regard, diverter assembly 300 may be any device or mechanism that passes cooling airflow from an evaporator chamber into a chilled chamber having multiple compartments in desired proportions.

Figure 13:
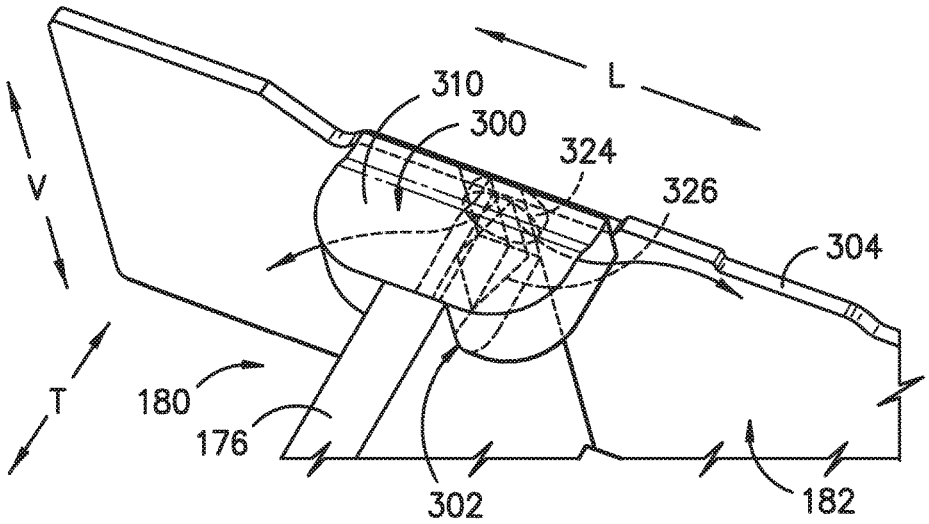
FIG. 13 provides a perspective view of the exemplary diverter assembly of FIG. 11.
Figure 14:
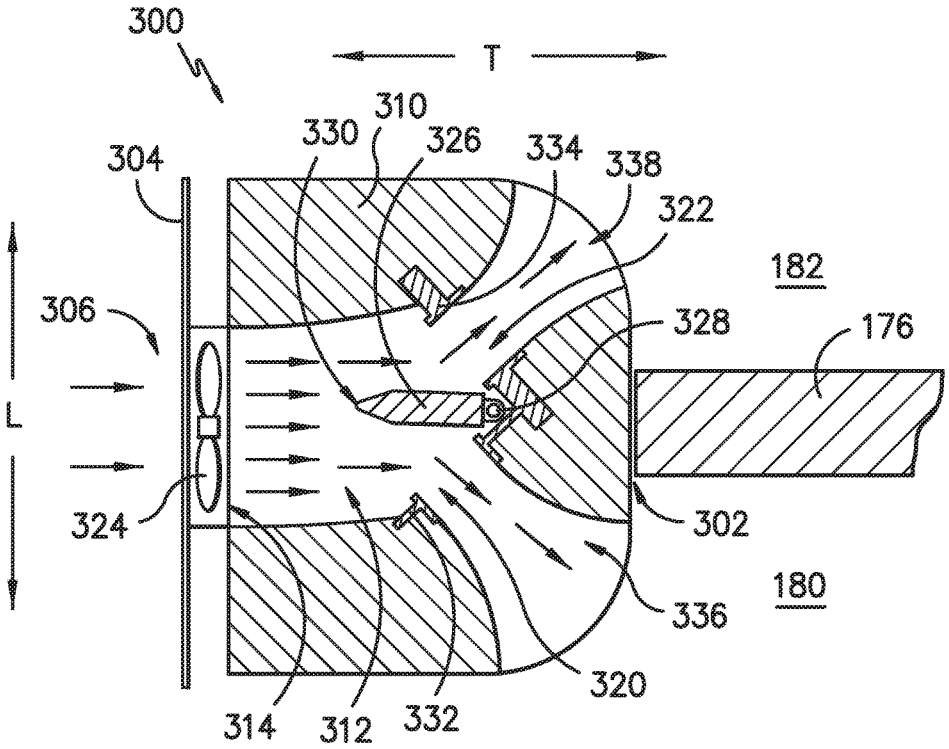
FIG. 14 provides a top cross sectional view of the exemplary diverter assembly of FIG. 11 with a damper positioned in a neutral position for splitting the cooling airflow.
Figure 15:
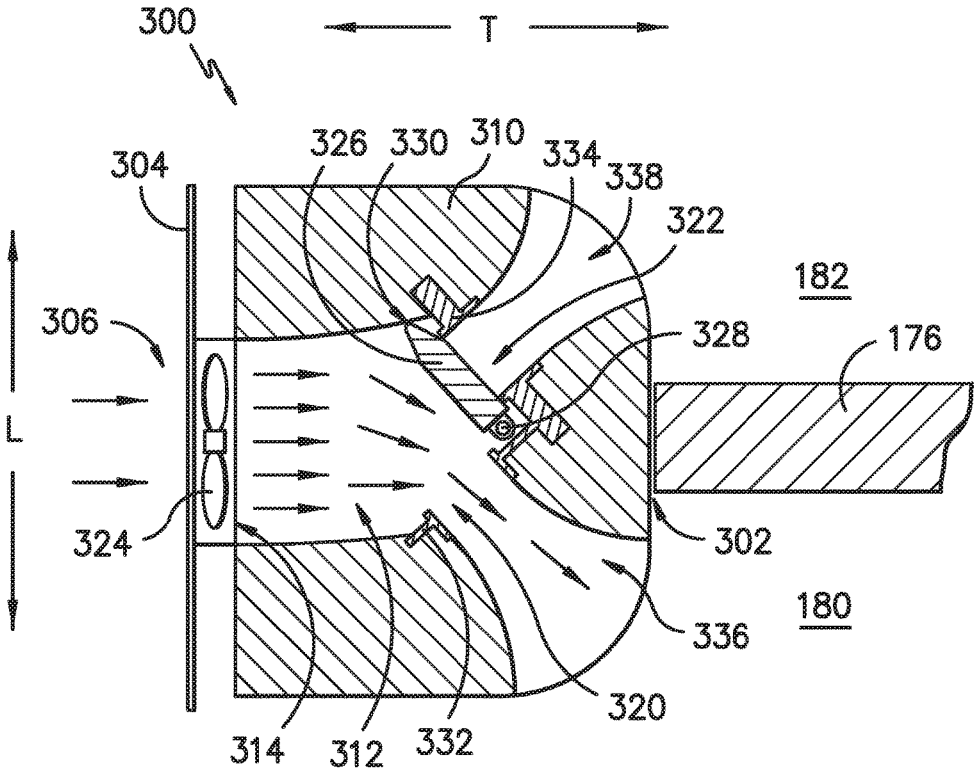
FIG. 15 provides a top cross sectional view of the exemplary diverter assembly of FIG. 12 with a damper positioned to direct all of the cooling airflow into a single freezer compartment.

Referring now to FIGS. 13 through 15, diverter assembly 300 will be described in more detail. As illustrated, diverter assembly 300 includes a diverter housing 310 positioned within recess 302 of mullion 176 in a fluid tight manner. In this regard, for example, inner liner 160, mullion 176, evaporator cover 304, and diverter housing 310 may include one or more seals which prevent leaks between evaporator chamber 306 and freezer chamber 124.

Diverter housing 310 defines a plenum chamber 312 and an inlet 314 through which cooled air flows from evaporator chamber 306 into plenum chamber 312. In addition, diverter housing 310 defines a first outlet 320 in fluid communication with first freezer compartment 180 and a second outlet 322 in fluid communication with second freezer compartment 182. Diverter assembly 300 may further include a fan 324 for urging cooled air through plenum chamber 312. According to the illustrated embodiment, fan 324 is an axial fan positioned at inlet 314 of diverter housing 310. In this manner, fan 324 draws air from evaporator chamber 306 and urges it through plenum chamber 312, e.g., substantially along the transverse direction T.

Diverter assembly further includes a damper 326 that is pivotally mounted within plenum chamber 312 for selectively directing the cooled air through first outlet 320 and second outlet 322. In this regard, for example, damper 326 is vertically mounted within diverter housing 310 and is pivotable about the vertical axis V. As best shown in FIGS. 14 and 15, damper 326 is mounted about a pivot point 328 at a downstream relative to the flow of cooling air. In this manner, a leading edge 330 of damper 326 may extend upstream within plenum chamber 312. According to the illustrated embodiment, leading edge 330 of damper 326 is tapered to avoid stagnation of the flow at leading edge 330 and to reduce the formation of eddy currents or other flow perturbations.

According to the illustrated embodiment, damper 326 is pivotable between a first position such that first outlet 320 is sealed and cooled air passes only through second outlet 322 and a second position (illustrated in FIG. 15) such that second outlet 322 is sealed and cooled air passes only through first outlet 320. Notably, however, damper 326 may also be positionable at any intermediate position between the first position and the second position. In this manner, the relative amount of chilled air flowing into first freezer compartment 180 and second freezer compartment 182 may be selectively adjusted.

Flanges or other sealing surfaces may be defined on first outlet 320 or second outlet 322, e.g., in order to ensure a proper seal with damper 326. More specifically, first outlet 320 may include a first outlet flange 332 that is configured for forming a seal with damper 326 when it is in the first position and second outlet 322 includes a second outlet flange 334 that is configured for forming a seal with damper 326 when it is in the second position. Each of first outlet flange 332 and second outlet flange 334 may be formed of a resilient material, such as rubber, to form a fluid seal with damper 326 and prevent undesired fluid leaks from plenum chamber 312 into first freezer compartment 180 or second freezer compartment 182.

Diverter housing 310 may further define one or more passageways downstream from first outlet 320 or second outlet 322 to direct the flow of chilled air into desired locations within freezer chamber 124. For example, diverter housing 310 may define a first passageway 336 providing fluid communication between first outlet 320 and first freezer compartment 180 and a second passageway 338 providing fluid communication between second outlet 322 and second freezer compartment 182. According to the illustrated embodiment, first passageway 336 and second passageway 338 each extend from plenum chamber 312 at an angle of approximately forty-five degrees, i.e., at forty-five degrees relative to the transverse direction T. However, first passageway 336 and second passageway 338 may extend at any suitable angle for reaching a particular area of freezer chamber 124, for reducing flow resistance, etc.

In order to adjust the proportion of airflow to first freezer compartment 180 and second freezer compartment 182, outlets 320, 322 and passageways 336, 338 may have any suitable size, shape, and orientation. For example, according to an exemplary embodiment, second outlet 322 and second passageway 338 may have a smaller cross sectional area to provide more flow resistance and urge more cooling airflow to first freezer compartment 180. Likewise, the actual flow resistance in each compartment 180, 182 may differ due to geometry differences or non-symmetrical frost buildup between the left and right sections of evaporator 198. This difference can also precipitate damper positions other than 45 degrees to attain equal airflow to each compartment 180, 182. In addition, the air temperature that is discharged to each compartment 180, 182 could vary due to heat leakage imbalances in the foamed case assemblies which could potentially drive a different flow volume requirement for each compartment 180, 182. In such a configuration, positioning damper 326 in a neutral position, i.e., at about forty-five degrees, will not necessary result in an even split of the cooling airflow. Instead, due to the flow restrictions in second outlet 322 and second passageway 338, a larger proportion of airflow will tend to flow into first freezer compartment 180. According to exemplary embodiments, controller 144 could monitor the actual temperatures of compartments 180, 182 and throttle damper 326 and/or control sealed system 190 to achieve the set point temperatures in each compartment 180, 182.

As one skilled in the art will appreciate, the above described embodiments are used only for the purpose of explanation. Modifications and variations may be applied, other configurations may be used, and the resulting configurations may remain within the scope of the invention. For example, evaporator 198 may have different positions or configurations, air supply and return ducts may be moved or may have different shapes, and different sealed system configurations may be used. Moreover, diverter assemblies, crossover ducts, and damper assemblies may be interchangeably used in various alternative embodiments. Such modifications and variations are considered to be within the scope of the present subject matter.

Now that the construction and configuration of diverter assembly 300 and freezer chamber 124 according to an exemplary embodiment of the present subject matter has been presented, an exemplary method 400 for regulating a diverter assembly to adjust the temperature of a freezer compartment is provided. Method 400 can be used to regulate diverter assembly 300, or any other suitable diverter assembly. It should be appreciated that the exemplary method 400 is discussed herein only to describe exemplary aspects of the present subject matter, and is not intended to be limiting.

Figure 16:
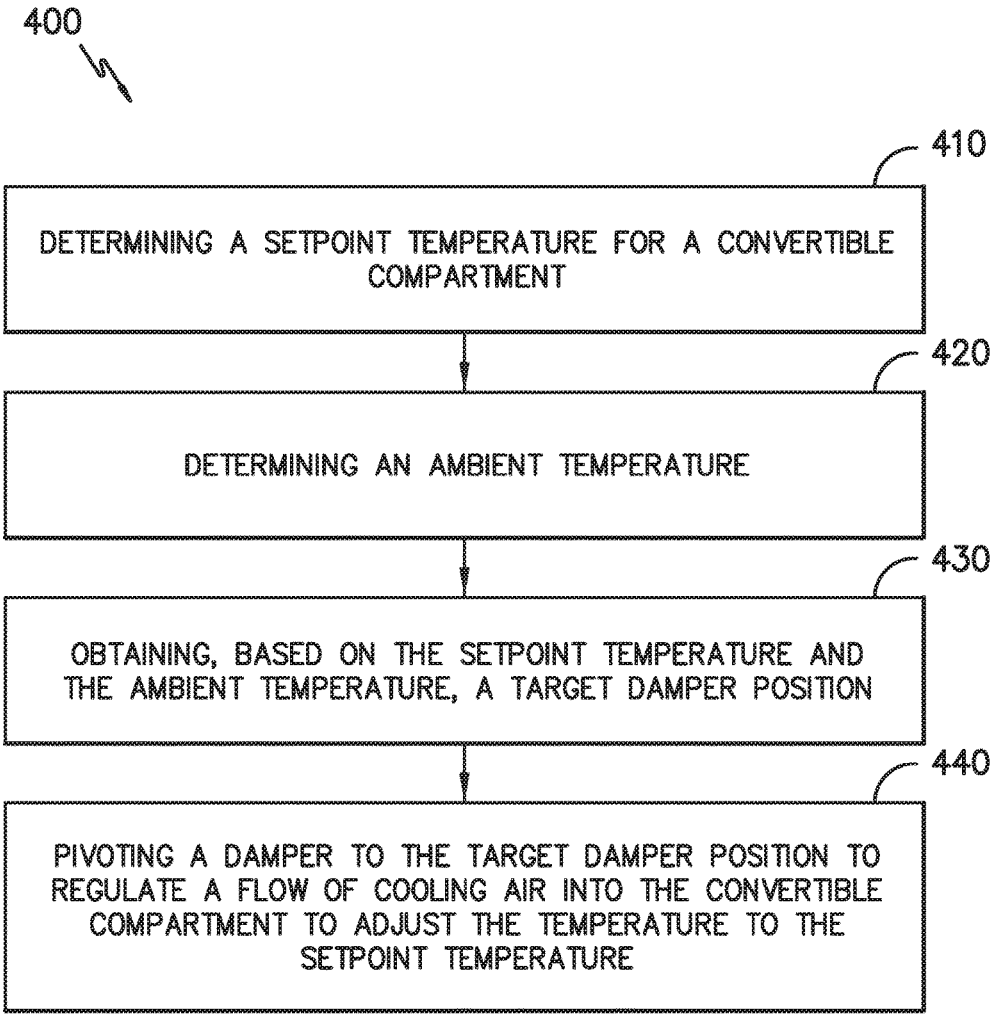
FIG. 16 is a method for regulating a diverter assembly according to an exemplary embodiment of the present subject matter.

Referring now to FIG. 16, method 400 generally includes, at step 410, determining a setpoint temperature for a convertible compartment. The convertible compartment may be, for example, second freezer compartment 182 from the embodiments above. It may be desirable to adjust the setpoint temperature of this compartment, for example, somewhere between the freezer chamber temperature and the fresh food chamber temperature (e.g., between about 0° F. and 37° F.). The setpoint temperature may be input by a user, set by a manufacturer, etc.

Method 400 includes, at step 420, determining an ambient temperature. The ambient temperature is the temperature of the external environment in which the refrigerator appliance is contained, e.g., in the kitchen. The setpoint temperature is needed because the amount of airflow necessary to maintain a desired temperature of the convertible compartment will vary according to the external temperature.

Step 430 includes obtaining, based on the setpoint temperature and the ambient temperature, a target damper position. The target damper position is the damper position which will result in the convertible compartment temperature reaching the setpoint temperature. According to an exemplary embodiment, the target damper position is empirically determined and stored in a database. For example, the manufacturer may runs tests to determine the target damper position needed to achieve the setpoint temperature for a variety of setpoint temperatures and ambient conditions. The empirical data may be stored in a table or database where it may be accessed to obtain the target damper position. Alternatively, the relationship between ambient temperature, setpoint temperature, and target damper position may be established in an algorithm or computer program/simulation. At step 440, the damper is pivoted to the target damper position to regulate a flow of cooling air into the convertible compartment to adjust the temperature to the setpoint temperature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet comprising an inner liner defining a freezer chamber;

a mullion positioned within the freezer chamber and extending along the transverse direction to divide the freezer chamber into a first freezer compartment and a second freezer compartment;

a first evaporator cover positioned within the first freezer compartment to define a first evaporator chamber, the first evaporator cover defining a first return duct providing fluid communication between the first freezer compartment and the first evaporator chamber;

a second evaporator cover positioned within the second freezer compartment to define a second evaporator chamber, the second evaporator cover defining a second return duct providing fluid communication between the second freezer compartment and the second evaporator chamber;

an evaporator coil positioned in both the first evaporator chamber and the second evaporator chamber, the evaporator coil passing from the first evaporator chamber to the second evaporator chamber through an evaporator recess defined by the mullion; and a crossover duct defined through and extending from the mullion for providing fluid communication between the first evaporator chamber and the second evaporator chamber.

2. The refrigerator appliance of claim 1, wherein the crossover duct extends along the lateral direction between the first return duct and the second return duct.

3. The refrigerator appliance of claim 1, wherein the first evaporator cover defines a first supply duct and the second evaporator cover defines a second supply duct.

4. The refrigerator appliance of claim 3, wherein the first return duct and the second return duct are positioned at a bottom of the freezer chamber and the first supply duct and the second supply duct are positioned at a top of the freezer chamber.

5. The refrigerator appliance of claim 3, further comprising:

a first fan is positioned in the first supply duct for urging chilled air into the first freezer compartment; and a second fan is positioned in the second supply duct for urging chilled air into the second freezer compartment.

6. The refrigerator appliance of claim 3, further comprising:

a supply damper assembly for selectively opening and closing the second supply duct; and a return damper assembly for selectively opening and closing the second return duct.

7. The refrigerator appliance of claim 1, further comprising a crossover damper positioned within the crossover duct and configured for selectively opening or closing the crossover duct.

8. The refrigerator appliance of claim 1, further comprising a diverter assembly configured for selectively directing cooled air into the freezer chamber, the diverter assembly comprising:

a diverter housing defining a plenum chamber, an inlet through which cooled air flows from the first evaporator chamber and the second evaporator chamber into the plenum chamber, a first outlet in fluid communication with the first freezer compartment, and a second outlet in fluid communication with the second freezer compartment;

a fan for urging cooled air through the plenum chamber; and a damper pivotally mounted within the plenum chamber for selectively directing the cooled air through the first outlet and the second outlet.

9. The refrigerator appliance of claim 8, wherein the first return duct and the second return duct are positioned at a bottom of the freezer chamber and the diverter assembly is positioned at a top of the freezer chamber.

10. The refrigerator appliance of claim 1, wherein the crossover duct is a return crossover duct and is positioned at a bottom of the first evaporator chamber and the second evaporator chamber, and wherein the refrigerator appliance further comprises:

a supply crossover duct defined in the mullion at a top of the first evaporator chamber and the second evaporator chamber for providing fluid communication between the first evaporator chamber and the second evaporator chamber.

11. The refrigerator appliance of claim 10, further comprising a supply crossover damper positioned within the supply crossover duct and configured for selectively opening or closing the supply crossover duct.

12. A refrigerator appliance comprising:

a cabinet comprising an inner liner defining a freezer chamber;

an evaporator coil positioned along a back wall within the freezer chamber;

a mullion positioned within the freezer chamber and extending along a transverse direction to divide the freezer chamber into a first freezer compartment and a second freezer compartment, the mullion defining an evaporator recess for receiving the evaporator coil;

a first evaporator cover positioned within the first freezer compartment, the first evaporator cover, the mullion, and the inner liner defining a first evaporator chamber;

a second evaporator cover positioned within the second freezer compartment, the second evaporator cover, the mullion, and the inner liner defining a second evaporator chamber; and a crossover duct defined through and extending from the mullion to provide fluid communication between the first evaporator chamber and the second evaporator chamber.

13. The refrigerator appliance of claim 12, wherein the first evaporator cover defines a first return duct and a first supply duct, the first return duct and the first supply duct providing fluid communication between the first freezer compartment and the first evaporator chamber, wherein the second evaporator cover defines a second return duct and a second supply duct, the second return duct and the second supply duct providing fluid communication between the second freezer compartment and the second evaporator chamber, and wherein the first return duct and the second return duct are positioned at a bottom of the freezer chamber and the first supply duct and the second supply duct are positioned at a top of the freezer chamber.

14. The refrigerator appliance of claim 12, further comprising:

a first fan is positioned in the first supply duct for urging chilled air into the first freezer compartment; and a second fan is positioned in the second supply duct for urging chilled air into the second freezer compartment.

15. The refrigerator appliance of claim 12, further comprising:

a supply damper assembly for selectively opening and closing the second supply duct; and a return damper assembly for selectively opening and closing the second return duct.

16. The refrigerator appliance of claim 12, further comprising a crossover damper positioned within the crossover duct and configured for selectively opening or closing the crossover duct.

17. A refrigerator appliance defining a vertical direction, a lateral direction, and a transverse direction, the vertical, lateral, and transverse directions being mutually perpendicular, the refrigerator appliance comprising:

a cabinet comprising an inner liner defining a freezer chamber;

a mullion positioned within the freezer chamber and extending along the transverse direction to divide the freezer chamber into a first freezer compartment and a second freezer compartment;

an evaporator cover positioned within the freezer chamber to define an evaporator chamber, the evaporator chamber having a first region at the first freezer compartment and a second region at the second freezer compartment, the evaporator cover defining a first return duct providing fluid communication between the first freezer compartment and the first region of the evaporator chamber and a second return duct providing fluid communication between the second freezer compartment and the second region of the evaporator chamber;

an evaporator coil positioned within the evaporator chamber, the evaporator coil configured for cooling air in the evaporator chamber; and a crossover duct positioned within the evaporator chamber, the crossover duct defined through and extending from the mullion and providing fluid communication between the first region of the evaporator chamber and the second region of the evaporator chamber.

18. The refrigerator appliance of claim 17, wherein the evaporator cover defines a first supply duct, the first return duct and the first supply duct providing fluid communication between the first freezer compartment and the first region of the evaporator chamber, wherein the evaporator cover defines a second supply duct, the second return duct and the second supply duct providing fluid communication between the second freezer compartment and the second region of the second evaporator chamber, and wherein the first return duct and the second return duct are positioned at a bottom of the freezer chamber and the first supply duct and the second supply duct are positioned at a top of the freezer chamber.

19. The refrigerator appliance of claim 17, further comprising:

a first fan is positioned in the first supply duct for urging chilled air into the first freezer compartment;

a second fan is positioned in the second supply duct for urging chilled air into the second freezer compartment;

a supply damper assembly for selectively opening and closing the second supply duct; and a return damper assembly for selectively opening and closing the second return duct.

20. The refrigerator appliance of claim 19, further comprising a crossover damper positioned within the crossover duct and configured for selectively opening or closing the crossover duct.

* * * * *